US006595003B2

(12) United States Patent
Dalla Betta et al.

(10) Patent No.: US 6,595,003 B2
(45) Date of Patent: Jul. 22, 2003

(54) PROCESS AND APPARATUS FOR CONTROL OF $NO_X$ IN CATALYTIC COMBUSTION SYSTEMS

(76) Inventors: Ralph A. Dalla Betta, 865 Doverton Sq., Mountain View, CA (US) 94043; Sarento G. Nickolas, 1569 Park Ridge Dr., San Jose, CA (US) 95118; Timothy J. Caron, 1421 Peregrine Dr., Gilroy, CA (US) 95020; Jon G. McCarty, 138 Yale Rd., Menlo Park, CA (US) 94025; Mark J. Spencer, 6965 Rodling Dr. #A, San Jose, CA (US) 95138; Robert A. Corr, II, 2071 Monaco Ct., El Cajon, CA (US) 92019

( * ) Notice: Subject to any disclaimer, the term of this patent is extended or adjusted under 35 U.S.C. 154(b) by 0 days.

(21) Appl. No.: 09/944,094

(22) Filed: Aug. 31, 2001

(65) Prior Publication Data

US 2002/0056276 A1 May 16, 2002

Related U.S. Application Data

(60) Provisional application No. 60/229,576, filed on Aug. 31, 2000.

(51) Int. Cl.[7] ..... F02C 7/00; F02G 1/02

(52) U.S. Cl. ..... 60/777; 60/778; 60/39.55; 60/723

(58) Field of Search ..... 60/775, 777, 39.3, 60/39.53, 39.55, 723

(56) References Cited

U.S. PATENT DOCUMENTS 4,283,634 A 8/1981 Yannone et al. ..... 290/40
4,380,146 A 4/1983 Yannone et al. ..... 60/39.141
4,687,491 A 8/1987 Latty (List continued on next page.)

OTHER PUBLICATIONS

Bhargava, A., et al ASME, 99–GT–8 (1999).
Touchton, G., ASME, 84–JPGC–GT–3 (1985).
Dryer, F., Sixteenth International Symposium on Combustion, The Combustion Institute, p 279 (1976).
Miyauchi, T., et al., Eighteenth International Symposium on Combustion, The Combustion Institute, p. 43 (1981).
Meyer, J., and Grienche, G., ASME, 97–GT–506 (1997).
Blevens, L, and Roby, R., ASME, 95–GT–327 (1995).
Anderson, D.N. and Tacine, R.R. "Catalytic Combustion with Steam Injection," *ASME*. 82–JPGC–GT–23: 1–9.

(List continued on next page.)

*Primary Examiner*—Charles G. Freay
(74) *Attorney, Agent, or Firm*—Morrison & Foerster LLP

(57) ABSTRACT

Methods and apparatus for control of $NO_x$ in catalytic combustion systems, and more particularly to control of thermal or/and prompt $NO_x$ produced during combustion of liquid or gaseous fuels in the combustor sections of catalytic combustor-type gas turbines, by controlled injection of water in liquid or vapor form at selected locations, orientations, amounts, rates, temperatures, phases, forms and manners in the compressor and combustor sections of gas turbines. The ratio of thermal $NO_x$ ppm reduction to water addition, in weight %, is on the order of 4–20, with % $NO_x$ reduction on the order of up to about 50–80% and $NO_x$ of below 2 ppm. Liquid water, steam or superheated steam can be used to reduce $NO_x$ in combustion systems operating at reaction zone temperatures above 900° C., preferably 1400° C. to 1700° C. The amount of water added is sufficient to provide a concentration of water in the range of from about 0.1% to about 20% by weight of the total air and fuel mixture flowing into the post catalyst reaction zone. Water is introduced simultaneously or sequentially in a plurality of locations, at selected rates, amounts, temperatures, forms, and purity, preferably in accord with a suitable control algorithm.

20 Claims, 3 Drawing Sheets

U.S. PATENT DOCUMENTS

| | | | | |
|---|---|---|---|---|
| 4,930,454 | A | 6/1990 | Latty et al. | |
| 5,095,221 | A | 3/1992 | Tyler | 290/40 |
| 5,183,401 | A | 2/1993 | Dalla Betta et al. | 431/7 |
| 5,232,357 | A | 8/1993 | Dalla Betta et al. | 431/7 |
| 5,250,489 | A | 10/1993 | Dalla Betta et al. | 502/262 |
| 5,281,128 | A | 1/1994 | Dalla Betta et al. | 431/7 |
| 5,425,632 | A | 6/1995 | Tsurumi et al. | 431/7 |
| 5,729,967 | A | 3/1998 | Joos et al. | |
| 5,826,422 | A * | 10/1998 | Koyama et al. | 422/177 |
| 5,987,878 | A | 11/1999 | Koyama et al. | |
| 6,095,793 | A * | 8/2000 | Greeb | 431/11 |
| 6,294,842 | B1 | 9/2001 | Skowronski | |

OTHER PUBLICATIONS

Dalla Betta, R.A. et al. "Catalytic Combustion Technology to Achieve Ultra Low $NO_x$ Emissions: Catalyst Design and Performance Characteristics." pp. 154–157.

Dalla Betta, R.A. et al. (1997). "Development of a Catalytic Combustor for a Heavy–Duty Utility Gas Turbine," *Journal of Engineering For Gas Turbines and Power* 119: 844–851.

Hayes, R.E. et al. (1999). "Catalytic Combustion of Methane in a Monolith Washcoat: Effect of Water Inhibition on the Effectiveness Factor," *The Canadian Journal of Chemical Engineering* 77: 688.

* cited by examiner

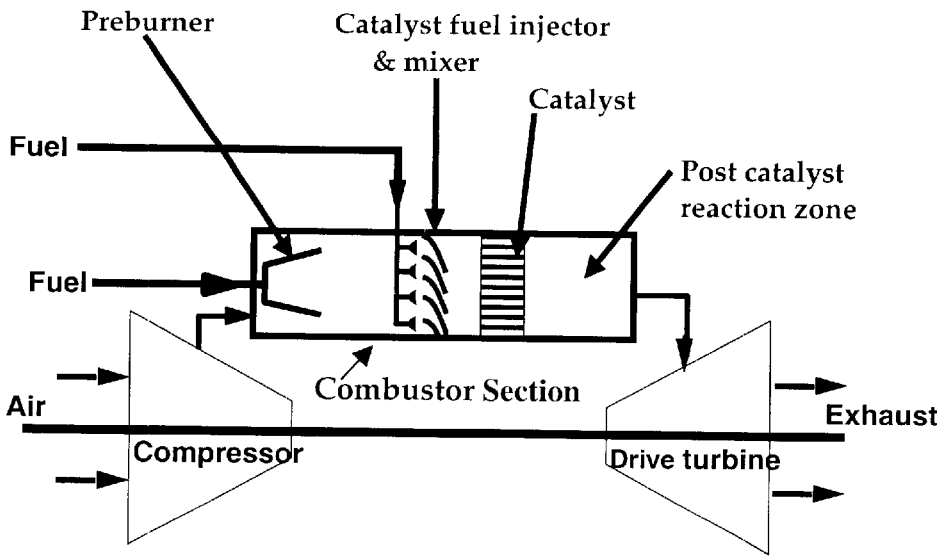
Fig. 1, Background Prior Art
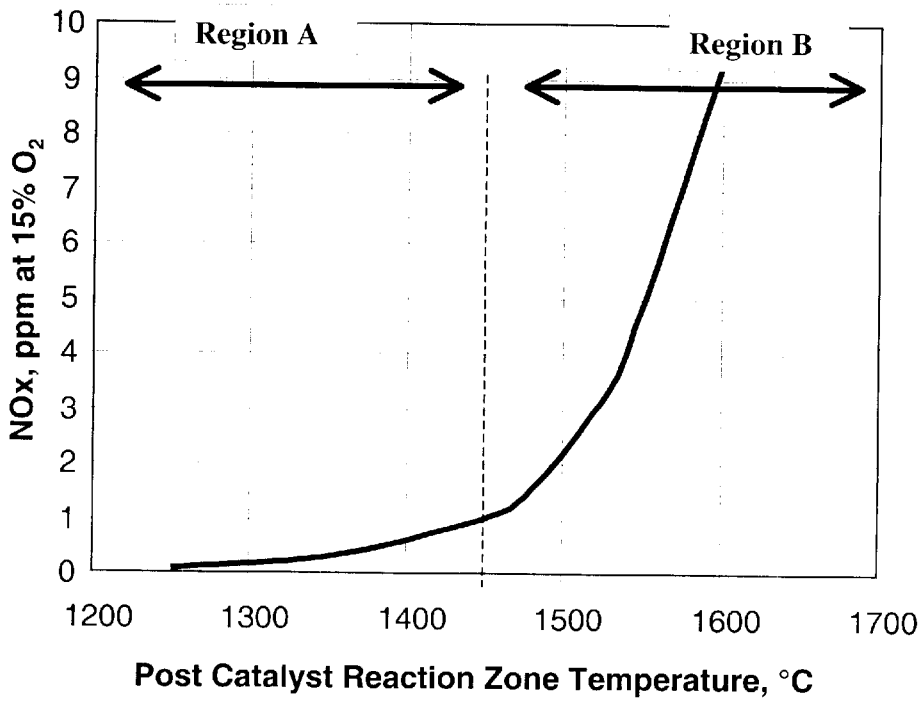
NOx produced vs
Temperature in a catalytic combustion system
Fig. 2, Background Prior Art

PROCESS AND APPARATUS FOR CONTROL OF $NO_X$ IN CATALYTIC COMBUSTION SYSTEMS

CROSS-REFERENCE TO RELATED CASE

This application is the Regular U.S. Application of our earlier-filed Provisional Application of the same title, Ser. No. 60/229,576 filed Aug. 31, 2000. This application is also related to copending Ser. No. 09/042,976, filed Aug. 29, 2001, by some of us (Yee, Velasco, Nickolas and Dalla Betta), entitled CONTROL STRATEGY FOR FLEXIBLE CATALYTIC COMBUSTION SYSTEM. The benefit of the filing and priority dates of these applications are hereby claimed under 35 U.S.Code, §§ 119 and 120.

FIELD OF THE INVENTION

The invention relates to methods and apparatus, both devices and systems, for control of $NO_x$ in catalytic combustion systems, and more particularly to control of thermal or/and prompt $NO_x$ produced during combustion of liquid or gaseous fuels in the combustor sections of catalytic combustor-type gas turbines, by controlled injection of water in liquid or vapor form at selected locations, orientations, amounts, rates, temperatures, phases, forms and manners in the combustor and/or compressor sections of gas turbines. The ratio of $NO_x$ ppm reduction to water addition, in weight %, is on the order of 4–20, with % $NO_x$ reduction on the order of up to about 50–80%, or more, and $NO_x$ of below 2 ppm being achievable by the inventive process.

BACKGROUND OF THE FIELD

Gas turbines are used for a variety of purposes, among them being motive power, gas compression and generation of electricity. The use of gas turbines for electrical generation is of particular growing interest due to a number of factors, among them being modularity of design, good ratio of generation output capacity to size and weight, portability, scalability, and efficiency. They also generally use low sulfur hydrocarbon fuels, principally natural gas, which offers the promise of lower sulfur oxides ($SO_X$) pollutant output. This is particularly important in the case of use of gas turbines for power generation in urban areas, where they are attractive for grid in-fill to cover growing power needs as urban densification occurs.

However, gas turbines operate at high temperature, in the range of from about 1100° C. for moderate efficiency turbines, to 1500° C. for modern high efficiency engines. To achieve these temperatures at the turbine inlet, the upstream combustor section must produce a somewhat higher temperature, generally 1200 to 1600° C. to compensate for air infiltration as a result of seal leakage or the purposeful addition of air for cooling of the metal walls. At these temperatures, the combustion system will produce $NO_x$, in amounts increasing as the temperature increases. The increased amounts of $NO_x$ need to be reduced to meet increasingly stringent emissions requirements.

Current Gas Turbine Systems

A typical gas turbine system comprises a compressor upstream of, and feeding compressed air to, a combustor section in which fuel is injected and burned to provide hot gases to the drive turbine which is located just downstream of the combustor section. FIG. 1 shows a conventional system of the type described in U.S. Pat. No. 5,183,401 by Dalla Betta et al., U.S. Pat. No. 5,232,357 by Dalla Betta et al., U.S. Pat. No. 5,250,489 by Dalla Betta et al., U.S. Pat. No. 5,281,128 by Dalla Betta et al., and U.S. Pat. No. 5,425,632 by Tsurumi et al. These types of turbines employ an integrated catalytic combustion system in the combustor section. Note the combustor section comprises the apparatus system between the compressor and the drive turbine.

As shown in FIG. 1 the illustrative combustor section comprises: a housing in which is disposed a preburner; fuel source inlets; catalyst fuel injector and mixer; one or more catalyst sections; and a post catalyst reaction zone. The preburner burns a portion of the total fuel to raise the temperature of the gas mixture entering the catalyst, and some $NO_x$ is formed there. Additional fuel is introduced downstream of the preburner and upstream of the catalyst and is mixed with the process air by an injector mixer to provide a fuel/air mixture (F/A mixture). The F/A mixture is introduced into the catalyst where a portion of the F/A mixture is oxidized by the catalyst, further raising the temperature. This partially combusted F/A mixture then flows into the post catalyst reaction zone wherein auto-ignition takes place a spaced distance downstream of the outlet end of the catalyst module. The remaining unburned F/A mixture combusts in what is called the homogeneous combustion (HC) zone (within the post catalyst reaction zone), raising the process gases to the temperature required to efficiently operate the turbine. Note that in this catalytic combustion technology, only a portion of the fuel is combusted within the catalyst module and a significant portion of the fuel is combusted downstream of the catalyst in the HC zone.

Each model and type of drive turbine has a required inlet temperature, called the design temperature or turbine inlet temperature. In addition, because cooling air is injected just upstream of the drive turbine, the outlet temperature of the combustor must in fact be higher then the turbine inlet temperature. For proper operation of a gas turbine at high efficiency, the combustor section outlet temperature must be continuously controlled to be maintained at the desired combustor outlet temperature. Typically, the turbine inlet temperature ranges from about 900° C. to about 1250° C. and the required combustor outlet temperature can be as high as 1500° C. to 1600° C. At these high temperatures, additional $NO_x$ is formed in the post catalyst reaction zone of the combustor section of FIG. 1. Although the $NO_x$ level produced in the catalytic combustor is typically low for natural gas and similar fuels, it is still desirable to reduce this level even further to meet increasingly stringent emissions requirements.

The relationship between temperature in the turbine combustor section and $NO_x$ produced therein is shown in FIG. 2. FIG. 2 shows the level of $NO_x$ that ordinarily is produced in a combustor of the type shown in FIG. 1. At temperatures below about 1450° C., identified in the figure as Region A, the level of $NO_x$ produced is below 1 ppm. As seen in FIG. 2, at temperatures above about 1450° C., the Region B lower boundary, the $NO_x$ level rises rapidly, with 5 ppm produced at 1550° C., and even higher levels, 9 to 10 or more ppm, above that temperature. For gas turbines that require combustor outlet temperatures in Region B to achieve the drive turbine design (inlet) temperatures, and where emissions requirements demand emissions levels below 2 ppm, it becomes necessary to further modify the combustion system, including combustion process, apparatus and controls, to maintain the $NO_x$ level produced in the combustion section of a gas turbine system at lower $NO_x$ levels, for example, 2 ppm or less.

The top portion of FIG. 3 is an enlarged schematic of a portion of FIG. 1 showing the major components of a catalytic combustion system 12 located downstream of the preburner. The cataltic combustion system includes a catalyst fuel injector 11, one or more catalyst sections 13 and the post catalyst reaction zone 14 in which is located the HC (homogeneous combustion) zone 15. The bottom portion of FIG. 3 illustrates the temperature profile and fuel composition of the combustion gases as they flow through the combustor section described above. Temperature profile 17 shows gas temperature rise through the catalyst as a portion of the fuel is combusted. After a delay, called the ignition delay time 16, the remaining fuel reacts to give the full temperature rise. In addition, the corresponding drop in the concentration of the fuel 18 along the same path is shown as a dotted line.

Water Addition in Non-Catalytic Systems

A. Bhargava, et. al, in ASME 99-GT-8, 1999 reports on the addition of water to a fuel-air mixture, combusting it in a flame combustor and measuring the $NO_x$ level. That work was not done on a catalytic combustion system, but rather was done in a premixed combustion system in which the fuel and air is premixed prior to combustion. Further, the system tested by Bhargava, et. al. was a flame combustor system, as compared to a flameless catalytic system. The Bhargava combustion process relies on recirculation and other mechanisms to stabilize the flame combustion process. The Bhargava et al. report does show that water addition to the premixed fuel air mixture introduced into a flame combustor does reduce the $NO_x$ level produced by the flame combustor. Flame combustors may be used upstream of catalytic combustion modules.

In other work, water and steam have been added to and mixed with fuel in gas turbine and other non-catalytic, flame-type combustors for the purpose of reducing $NO_x$. See: G. Touchton, ASME, 84-JPGC-GT-3, 1985; F. Dryer, Sixteenth International Symposium on Combustion, The Combustion Institute, p. 279, 1976; T. Miyauchi et. al. Eighth International Symposium on Combustion, The Combustion Institute, p. 43, 1981; J. Meyer and G. Grienche, ASME, 97-GT-506, 1997; L. Blevens and R. Roby, ASME, 95-GT-327, 1995. The process by which such $NO_x$ reduction occurs is through the reduction of the temperature in the combustor flame zone. The fuel is mixed with water or steam, and this fuel/water mixture is then injected into the combustor and burned in a typical diffusion flame. The added mass of water, in either steam or liquid form, reduces the hot spot temperature of this type of flame combustor, thereby reducing the $NO_x$ level. The temperature reduction is due to the high heat capacity of the water or steam, and in the case of liquid water, additionally has a high heat of vaporization. The effect of the water or steam addition is to reduce the flame hot spot temperature so less $NO_x$ is produced at the lower temperatures. None of Bhargava, Touchton, Miyauchi, Meyer or Blevens disclose employing controllers for continuous control of $NO_x$ by control of water addition.

Catalytic Combustion Systems Are Different in Kind

However, flameless catalytic combustion systems are not the same as flame combustors, as is evident from FIG. 3, as a result of which the introduction of water into a catalytic system is not predictable. Indeed, catalytic combustion systems do not have localized high temperature spots nor do they employ recirculation, so addition of water for hot spot control is not needed. Further, water addition would be expected to quench the catalyst, or reduce the temperature being produced at the outlet of the combustor section to below the required drive turbine design temperature. Accordingly, one of ordinary skill in this art would not consider water addition to catalytic combustion systems, nor would they expect that water addition to a catalytic system would lead to reduction in $NO_x$.

Thus, there remains a significant need for $NO_x$ control and reduction in gas turbines, and more specifically in gas turbine combustor sections employing catalytic combustion systems.

THE INVENTION

SUMMARY, INCLUDING OBJECTS AND ADVANTAGES

The invention is directed to methods and apparatus, both devices and systems, for control of $NO_x$ in catalytic combustion systems, and more particularly to control of $NO_x$ produced during combustion of liquid or gaseous fuels in the combustor sections of gas turbines by controlled injection of water in liquid or vapor form at selected locations, orientations, amounts, rates and manners in the combustor and/or compressor sections of gas turbines.

The invention arises out of the discovery that the addition of water into at least one of a compressor and a combustor section having a catalytic combustion system has the effect of reducing the $NO_x$ produced in the post-catalyst homogeneous combustion zone downstream of the catalyst. The water may be introduced in a wide variety of modes, locations, amounts, rates, temperatures, phases and orientations, both in the combustor section and upstream of it in the compressor. For example, it has been found that the addition of water to the gas mixture that is fed to the catalyst module will reduce the $NO_x$ produced in the post catalyst homogeneous combustion zone by up to approximately 80% or more, to a concentration below about 2ppm $NO_x$ in the hot gases being introduced into the turbine.

By "addition" or "introduction of water" is meant addition or introduction of water in any phase or temperature, e.g., stream, spray, atomized or vapor form, the latter including hot water vapors or steam. The water can be hot, ambient, cool or cold, typically ranging from about −10° C. to over 400° C.

It should be understood that by reference to "air" is meant broadly the process gases flowing through the entire turbine system, as they change from air at the compressor inlet to combustion gases of varying oxygen content in the combustor section to the ultimate "product" hot gases stream at the discharge end of the post catalyst combustion zone of the combustor section.

It should be understood that a catalytic combustion system, properly operated, does not have a localized high temperature zone. Thus, the added water, considered as a diluent, needs to be compensated-for by added fuel to maintain the combustor outlet temperature. In the case of a catalytic combustion system such as that shown in FIG. 1, the overall combustor outlet temperature must be maintained at the level required by the gas turbine, i.e., the design temperature or turbine inlet temperature. Compensating amounts of fuel added to the preburner and injector/mixers is typically controlled in a straight-forward manner by the turbine control system.

It should be understood that the addition of water also can be strategically employed at various locations in selected amounts within the compressor and combustor sections to control the temperature profile shown in the bottom of FIG. 3. In this connection, it should be understood that it is within the scope and teachings of the inventive process to introduce water simultaneously in a plurality of locations in the compressor and combustor sections, in differing amounts, and/or at different rates, and/or at different temperatures or forms, to obtain the desired temperature profile and combustor outlet temperature control. Likewise, the inventive process includes introduction of water in programmed sequences at different locations in different amounts, at different rates, temperatures, phases, forms and modes in those sections. Such simultaneous and/or sequential introduction at multiple points and in varying amounts/rates/etc., along the gases path through the combustor and/or compressor section(s) may also be changed depending on the turbine operating cycle, from start up, through spool up, at load, during turn down, and shut off, and during changes in load cycle. The inventive process includes introduction of the water in accord with a suitable control algorithm, such as monitoring the temperature at one or more locations in the combustor and/or compressor section(s), monitoring the $NO_x$ in the post catalyst reaction zone or elsewhere along the process air path, and controlling the amount, location, temperature, form (e.g., phase or droplet size), mode and rate of water fed into the process to maintain the outlet temperature of the gases at the required temperature for efficient turbine operation.

The addition of water (in all cases "water" refers to either liquid water, steam or superheated steam) can be used to reduce $NO_x$ in combustion systems operating at reaction zone temperatures above 900° C. It is preferably applied to combustion systems operating at combustor outlet temperatures of 1400° C. to 1700° C., and most preferably at combustor outlet temperatures of 1450° C. to 1600° C. The amount of water added is sufficient to provide a concentration of water in the range of from about 0.1% to about 20% by weight of the total air and fuel mixture flowing into the post catalyst reaction zone. The preferred amount of water addition is in the range of about 0.5% to about 10%, and the most preferred range of water addition is from about 0.1% to about 5% by weight. As the amount of water added is increased, the effect on the $NO_x$ will be dependant on a number of factors including the reaction zone temperature range and the residence time at the reaction zone temperature. The ratio of $NO_x$ reduction in ppm to water addition in weight % ranges from on the order of about 4 to about 20.

The purity of water is also an important consideration, and it is a principle of the invention that good to high quality water is preferably employed so as to not introduce additional corrosive or catalyst poisoning components, or flame retardants or pollutant-causing or contributing components, molecules or ions. It is particularly important to use high purity water when injecting water upstream of the catalyst module, as the catalyst can be poisoned by a variety of water-born compounds. In addition, contaminants in the water can adversely impact the durability of the turbine downstream of the combustor.

For typical systems with reaction zone temperatures of from about 1400° C. to about 1600° C. and residence times of 3 to 20 ms (milliseconds), the addition of 1% weight water to the weight of total mass flow through the combustor will reduce the $NO_x$ by about 15%, at 2.5% wt/wt water the $NO_x$ will be reduced by about 30%, and at about 5% wt/wt water the $NO_x$ reduction is about 50% from the levels achievable without the addition of water.

By way of additional embodiments and advantages, the inventive process and apparatus for control of $NO_x$ via introduction of water include the following alternative water addition modes and/or locations, and control systems for the additions:

Water (as defined herein) is introduced at the compressor inlet or inter-stage in the compressor, where it can do double duty, both $NO_x$ reduction and providing an inter-cooling effect, particularly where the water is introduced as liquid water and is ambient, cool or cold. This can result in increased turbine power (for water introduction at the compressor inlet) and/or efficiency (both power and efficiency are increased by water addition interstage in the compressor).

Water can be introduced at the compressor discharge area, or in any location upstream of the preburner, if there is one. In this case the water will reduce the $NO_x$ produced in the preburner. In addition, the long passage of the air and water to the catalyst will help to mix the air and added water, and the catalyst fuel mixer system will further mix the air with the added water.

The water can be added by intermixing with the fuel, e.g., in the Fuel/Air injector/mixer ("Catalyst fuel injector & mixer") for the catalyst fuel as shown in FIG. 1, so the mixer does double duty, mixing the fuel and air, and mixing the fuel/air mixture with the water.

The fuel for the catalyst module is injected through a fuel peg comprising a cylindrical pipe having an internal passage for fuel and holes through the pipe wall directing the fuel into the air flow stream. In this embodiment of the invention, in a first alternative system and method, the water is added in a plurality of adjacent pegs specifically designed for water injection. In a second alternative of this embodiment, the water is injected via multiple passages within the fuel injection peg. In the latter embodiment, the water and fuel passages or lines to the fuel peg (spray heads or stubs) or injectors can be separate lines, or common lines can be sized and materials selected to be compatible with the mixture of fuel and water.

The water may be added downstream of the catalyst module, e.g., at or adjacent to the catalyst module outlet. In this embodiment, the water is piped to one or more distribution spray manifolds via the centerbody of the module, i.e., the module central axial rod or spindle that can be hollow to carry the water. Alternatively, the water can be introduced through the periphery of the liner downstream of the catalyst. The Fuel/Air ratio can be adjusted, and the fuel supplied can be increased to maintain the combustor outlet temperature. In this embodiment, the water purity requirement can be reduced to that required by the turbine, rather than a possibly higher purity required for water injection upstream of the catalyst module to guard against catalyst contamination.

Water (preferably steam) introduced at the catalyst module outlet is combined with additional fuel, and this fuel is burned in the post catalyst reaction zone, primarily in the HC zone, to obtain even higher temperatures at the combustor outlet. The fuel and steam, introduced separately but preferably as a mixture, will have greater mass, and will be more readily mixed into the hot process gases exiting the catalyst.

In another embodiment, the water can be injected upstream of the preburner to reduce preburner $NO_x$. In a typical catalytic combustion system used in a combustor section, the preburner is a premix preburner. In contrast, in typical combustors not employing catalytic combustion, a diffusion flame preburner is typically employed. The diffusion flame preburners are prone to producing $NO_x$. In accord with the process of this invention, water can be injected in association with a diffusion flame preburner. The advantages are that the diffusion flame preburners with water injection will then produce low $NO_x$, and the water will then flow to the catalytic combustion system where it will then further reduce the amount of additional $NO_x$ produced in the post catalyst reaction zone of the catalytic combustion system. Water injection is also useful for reducing $NO_x$ in a lean premix preburner.

Water can be injected between stages of a multi-stage combustion catalyst module, with water being conveniently ported to the appropriate stage via the center-body or via the periphery of the catalyst module.

Waste heat in the gas turbine exhaust, or in the exhaust of a downstream boiler can be recovered and used to convert water into high pressure steam which is then injected into the combustor section for the $NO_x$ control in accord with the principles of the invention. This minimizes energy consumption to evaporate and heat the water with a resulting increase in overall process efficiency. Thus, the water introduction system of the invention also provides a vehicle for efficient recovery and feed-back of heat into the combustion portion of the turbine system.

Catalyst modules may contain both catalyst-containing and catalyst-free (non-catalytic) channels. In such type of catalyst modules, the water can be introduced through the non-catalytic channels, with the advantage of eliminating effects of water on the catalyst coating. This also reduces the fuel content in the non-catalytic channels, which has the advantage of reducing the potential for hydrocarbon build up on the channel walls (soot or char build up) or of combustion of the fuel in these channels.

It should be understood that the embodiments described herein are exemplary only of the principles of the invention, and more than one mode and location of water introduction may be used simultaneously or sequentially. Further, different modes and locations of water introduction may be used at different times in the cycle of start-up, spool-up, continuous operation (including turn-up or turn-down to meet output load demand), and shut-down. The purity, amount, rate of introduction, temperature and form or phase, and liquid droplet size of water introduced in each location may be controlled empirically through feed-back controllers measuring, inter alia, temperature, $NO_x$ production, fuel usage and the like, or in accord with control system models or algorithms, including conventional, commercially available controllers, particularly where the water is premixed in the fuel.

A wide variety of control systems and controllers may be used, e.g, feed-back control system controllers, dynamic control systems, operating line or operating chart control systems, open loop or closed loop systems, and feed-forward control systems, to monitor operation of the turbine, the compressor section and the combustor section for appropriate water addition in accord in the principles of the invention. A control strategy and control system that is particularly useful by which water can be introduced into the combustor and/or compressor section in accord with this invention is shown in our copending Application U.S. Ser. No. 09/942,976, of Yee, Velasco, Nickolas and Dalla Betta, filed Aug. 29, 2001, entitled CONTROL STRATEGY FOR FLEXIBLE CATALYTIC COMBUSTION SYSTEM, the disclosure of which is hereby incorporated by reference to the extent required to enable one skilled in the art to adapt such controllers to include introduction of water in accord with the inventive process.

Other examples of control systems and fuel injection systems by which water may be introduced into the combustor and/or compressor section in accord with this invention include the following: Reed et al., U.S. Pat. No. 4,283,634 (1981—Westinghouse), describing a system and method for monitoring and controlling operation of industrial gas turbine apparatus and gas turbine electric power plants preferably with a digital computer control system; Tyler, U.S. Pat. No. 5,095,221 (1992—Westinghouse), disclosing a gas turbine control system having partial hood control; and Kiscaden et al., U.S. Pat. No. 4,380,146 (1983—Westinghouse) disclosing a system and method for accelerating and sequencing industrial gas turbines and electric power plant gas turbines by a digital computer control system.

BRIEF DESCRIPTION OF THE DRAWINGS

The invention is described by reference to the drawings in which:

FIG. 1 is a schematic of a conventional modern gas turbine, and as such represents background prior art;

FIG. 2 is a graph of Temperature vs $NO_x$ showing the knee in the curve at about 1450° F., below which is Region A of relatively low $NO_x$ production, and above which is Region B at the temperatures of which $NO_x$ is rapidly produced in a conventional gas turbine, thus representing background prior art;

Figure 3:
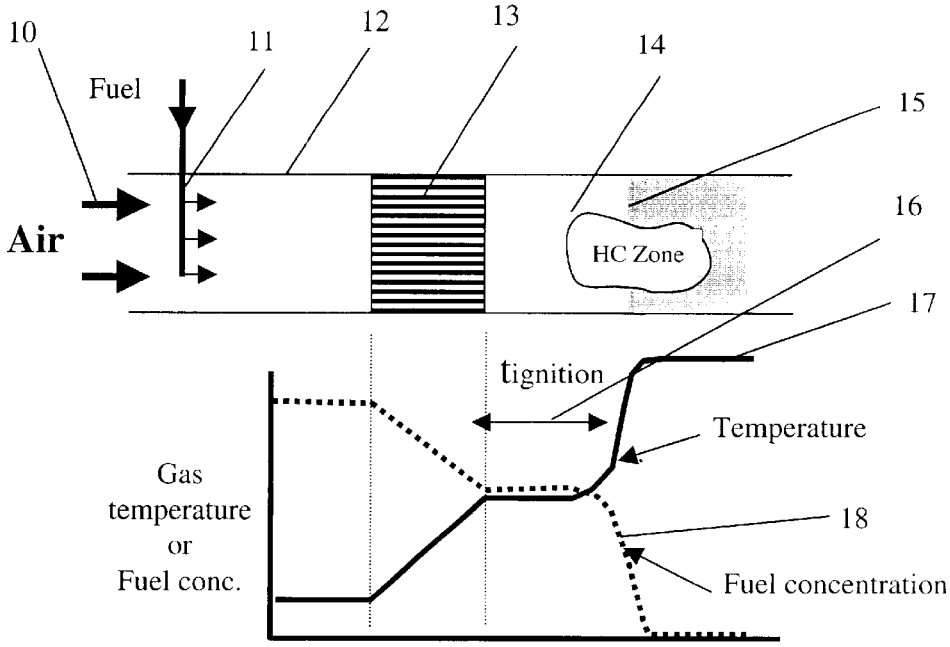
FIG. 3 is a related two-part figure, in which the upper portion is a schematic of the catalyst combustion system portion of the combustor section of FIG. 1, and immediately below that is the temperature profile through the catalyst module and the HC zone of the catalytic combustor.

DETAILED DESCRIPTION, INCLUDING THE CURRENT BEST MODE OF CARRYING OUT THE INVENTION

The following detailed description illustrates the invention by way of example, not by way of limitation of the principles of the invention. This description will clearly enable one skilled in the art to make and use the invention, and describes several embodiments, adaptations, variations, alternatives and uses of the invention, including what are presently believed to be the best modes of carrying out the invention.

In this regard, the invention is illustrated in the several figures and tables, and is of sufficient complexity that the many parts, interrelationships, process steps and sub-combinations thereof simply cannot be fully illustrated in a single patent-type drawing or table. For clarity and conciseness, several of the drawings show in schematic, or omit, parts or steps that are not essential in that drawing to a description of a particular feature, aspect or principle of the invention being disclosed. Thus, the best mode embodiment of one feature may be shown in one drawing, and the best mode of another feature will be called out in another drawing. Process aspects of the invention are described by reference to one or more examples or test runs which are merely expemplary of the many variations and parameters of operation under the principles of the invention.

EXAMPLES

A comparative bench-scale test was run without added water and with added water at conditions that are typical of a gas turbine catalytic combustor section. In the series of tests of this Example, a two stage catalyst combustion system was run under typical gas turbine combustor section conditions, namely the conditions for a modern high efficiency turbine at 1515° C. post catalyst reaction zone temperature, a gas pressure of 209 psig and at gas flow rates typical of a gas turbine combustor. Air was heated electrically and then fuel and water was introduced into the air stream at the required level prior to entering the catalyst module. The electrical heat was adjusted to control the gas temperature at the catalyst inlet at the required value. A gas sample was withdrawn downstream of the catalyst and sent to an analytical system to measure NO and $NO_2$ and reported as a total referred to as $NO_x$.

$NO_x$ results are shown in Table 1 below. The following parameters were kept constant during the test:

pressure=209psig, airflow=7871 slpm (1.75" catalyst diameter), catalyst inlet temperature =450° C., observed post catalyst reaction zone temperature =1515° C.

The residence time at the reaction zone temperature was calculated based on the post-catalyst thermocouple location where the temperature was greater than 80% of the final temperature.

TABLE 1

Effect of Water Injection on NOx Suppression

| Steady state point | Water added, % (mass) | Residence time, ms | NOx ppm | Reduction % |
|---|---|---|---|---|
| 16 | 0 | 8.8 | 2.38 | — |
| 3 | 0.48 | 8.8 | 2.16 | 9.2 |
| 4 | 0.95 | 8.7 | 1.93 | 18.9 |
| 7 | 1.65 | 8.6 | 1.73 | 27.3 |
| 13 | 0 | 15.6 | 3.16 | — |
| 12 | 0.47 | 15.5 | 2.82 | 10.8 |
| 11 | 0.95 | 15.4 | 2.58 | 18.4 |
| 10 | 1.65 | 15.3 | 2.32 | 26.6 |

These results indicate there is an unexpected and very significant decrease in $NO_x$ levels when water is added. For example, at 1.65% by weight of water addition, the $NO_x$ was reduced by about 27%.

Figure 4:
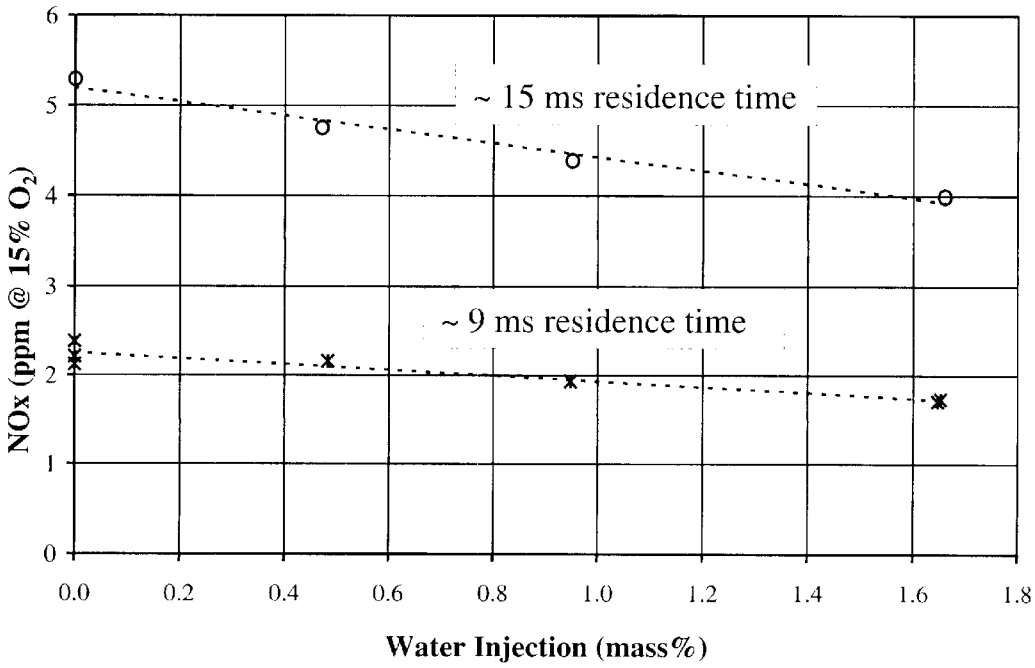
FIG. 4 is a graph of the results of the inventive process of injection of water in the catalytic combustion process in terms of $NO_x$ vs Water Injection, in % by mass.

In additional examples, a series of tests were run on the same apparatus as in the Example above in which the water content was varied. The results are shown in FIG. 4, with the data being taken at 1515° C. in the post catalyst reaction zone. FIG. 4 illustrates that there is a nearly linear decrease in $NO_x$ level as the water content is increased for a wide variation in residence time. While we do not wish to be bound by theory, the decrease in $NO_x$ may arise due to one or more of the following factors, or the interplay thereof, including:

The addition of water increases the velocity, thus the residence time decreases. Based on calculations, this effect appears to be minimal; or/and The addition of water increases the amount of fuel needed to achieve proper combustor outlet temperature for the turbine, resulting in lower oxygen content in the combustion gas, which oxygen is available to react with $N_2$ in the inlet air.

Discussion: Table 1 above is a summary of the significant data illustrating the principles of the method of this invention. It should be emphasized that these data are collected at the same reaction zone temperature, in each case about 1515° C., regardless of the amount of water added. In other words, the water addition does not reduce the $NO_x$ produced merely by reducing the flame temperature. Rather the water reduces the $NO_x$ at the same reaction zone temperature in a substantially linear relationship as a function of the mass of the added water.

Table 1 shows that the water/$NO_x$ reduction effect of the invention is unexpectedly large, the addition of only 1.65% water results in over 27% reduction in $NO_x$. This is particularly surprising in view of the fact that the combustion of methane fuel produces water, and while that combustion water is present in the reaction zone downstream of the catalyst, $NO_x$ is still being produced. That is, $NO_x$ is normally produced even in the presence of combustion water in non-water injection processes.

For the specific runs described above, about 40% of the fuel is combusted within the catalyst and the remainder downstream of the catalyst in the post catalyst combustion zone. For the case with no added water, the amount of water in the stream exiting the catalyst is about 0.024 mass fraction, while the total amount of water produced after total combustion in the post catalyst reaction zone is approximately 0.0605 mass fraction. The added 0.0165 mass fraction added water increases the water content at the catalyst exit by 68% and the total water content by 27%. Note that the reduction in $NO_x$, ~27%, is about the same as the added total mass fraction of water.

Figure 5:
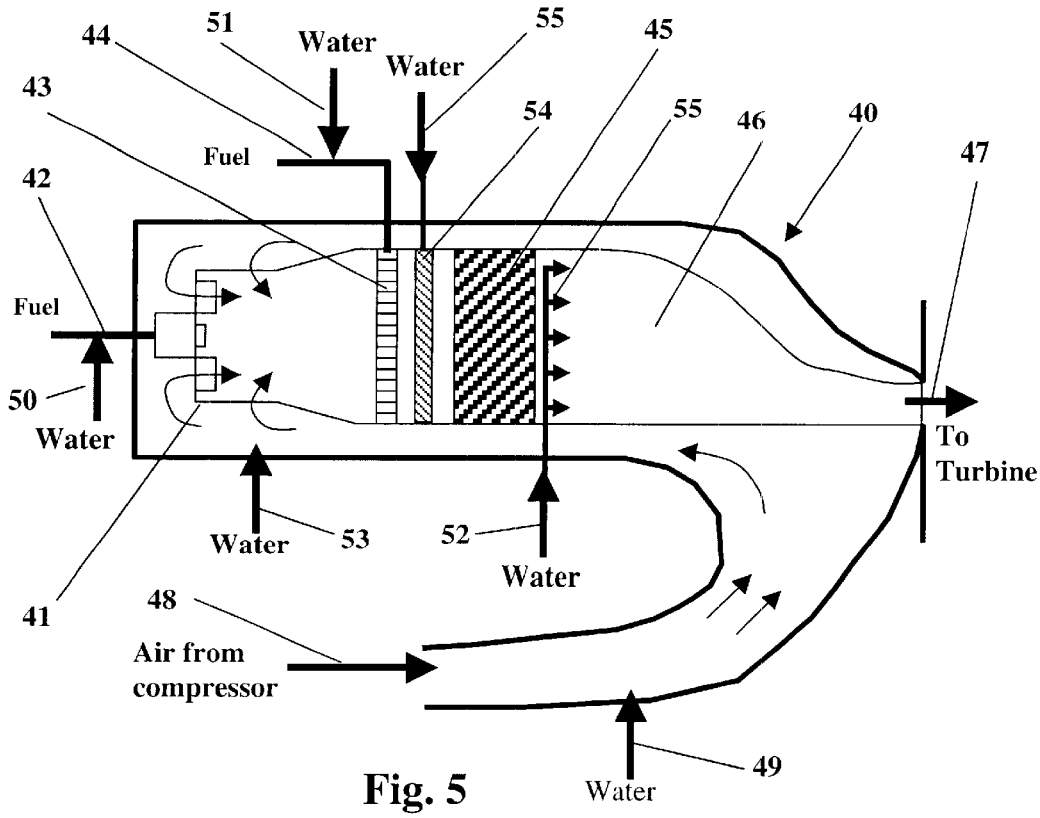
FIG. 5 shows several alternative locations for introduction of water in accord with the inventive methods and apparatus of this application.

FIG. 5 illustrates several alternative locations for the introduction of water in accord with the inventive process and apparatus system aspects. FIG. 5 is an enlarged schematic representation of a catalytic combustor 40 which includes: an air supply 48 from a compressor; a preburner assembly 41 having a fuel feed 42; a catalyst fuel injector assembly 43 having a fuel feed line 44; one or more catalyst sections 45; and a post catalyst reaction zone 46 supplying hot gas 47 to a drive turbine next upstream thereof (shown in FIG. 6).

Water can be introduced at location 49 where it is added to the air flow from the compressor before it enters the main combustor section. Since this air stream is quite hot, typically 250–450° C., it rapidly vaporizes liquid water. In addition, the air flow path to the preburner, catalyst fuel injector and catalyst will act to fully mix the water with the air prior to the homogeneous reaction zone. In general, water as liquid water or as steam can be introduced at any location between the compressor outlet and the preburner inlet, including in the combustor itself, such as at location 53 (generally characterized in the preburner flame zone).

Another alternative location for introduction of water is into the preburner inlet with the preburner fuel 42 as shown by water supply 50. At this location, water can be mixed with the fuel and injected into the preburner with the preburner fuel or it can be introduced through a separate supply line and a separate injector, or introduced via a different passage in the same injector (the fuel injector). Fuel introduced at this location can also act to reduce $NO_x$ produced in the preburner (the so-called "Prompt $NO_x$") as well as $NO_x$ produced downstream of the catalyst in the homogeneous combustion process (the "Thermal $NO_x$").

Water can also be introduced with the main catalyst fuel 44 as shown by water supply line 51. Again, at this location, water can be mixed with the fuel and injected into the catalyst fuel air mixer with the catalyst fuel, or it can be introduced through a separate supply line via a separate injector or a different passage in the same injector. A second injector 54 with water supply 55 is shown just downstream of the catalyst fuel injector 43. Alternatively, this separate water injector could be located upstream of the catalyst fuel injector.

Injecting water in the catalyst fuel injector location 51 has the advantage that the fuel air mixer designed to efficiently mix the catalyst fuel with the air will also act to mix the injected water with the air. The catalyst fuel injector system can be a multiplicity of pegs that extend into the flowing air stream. Each peg includes a fuel flow channel through the peg terminating in holes that eject the fuel into the air flow (gases flow). The water can be mixed with the fuel and the mixture is pumped through the same internal channels and injection holes. Alternatively, the peg can be designed with a second channel for the water flow, a separate water supply pipe and a second set of injection holes designed for the water. This latter approach is preferred since the water flow could be substantial and may require different channel sizing and different injection hole diameters. One skilled in the art can select appropriate nozzles for the injection of the water, and control of the spray droplet size for thorough turbulent and/or vapor mixing.

A completely separate injector 55 with water supply 52 can be provided downstream of catalyst 45 to inject water at this location. This water becomes mixed with the hot gas stream (residual fuel/air mixture) flowing out of the catalyst prior to combustion of the remaining fuel in the HC wave. This location is advantageous in that the added water does not flow through the catalyst, thereby minimizing the potential contamination of the catalyst by contaminants in the water. In applications using this location, it is presently preferred to employ additional mixer elements to ensure thorough mixing of the added water with the hot gases exiting the catalyst, as in present catalytic combustors no mixing device is located between the catalyst outlet and the downstream HC wave.

Figure 6:
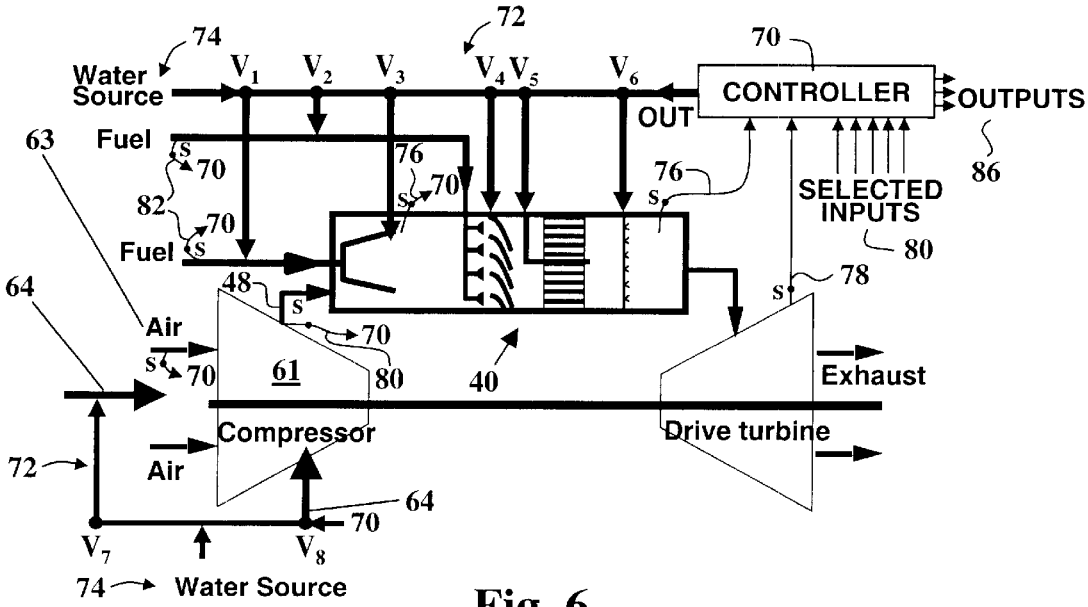
FIG. 6 shows a schematic of a gas turbine system with additional alternative locations for introduction of water including in the compressor section, and automated control thereof by means of a controller in accord with the inventive methods and apparatus of this application.

FIG. 6 shows a schematic of a complete gas turbine system; it should be understood that the combustor section of FIG. 5 may be employed as the combustor section 40 shown schematically in FIG. 6. Additional water injection locations are shown in this figure. Compressor 61 takes in air 63, compresses it and feeds high pressure air to the combustor 40 (shown in detail in FIG. 5). Water 63 can be added to the inlet air 62, and compressed and mixed with the inlet air. A significant advantage of this embodiment results from the fact that use of liquid water provides evaporative cooling of the inlet air, thus increasing the air flow through the compressor and increasing the power output of the gas turbine system.

Water can also be introduced in between compressor stages 64 in the compressor, thus acting to cool the air in the compressor. This inter-cooling also increases power output and in addition increases turbine efficiency. Introduction of water upstream of the compressor or inter-stage in the compressor also takes advantage of the compressor and downstream pathway components to mix the water with the air.

FIG. 6 also shows a controller 70 that controls one or more water introduction valves $V_1$–$V_8$ in a manifold 72 (which includes suitable spray heads or injection pegs) for injection of water from water source 74. Various sensors, S, provide suitable, selected inputs to the controller for the water injection control algorithm, such as but not limited inputs of: temperature and/ or $NO_x$ sensor(s) signals 76, turbine operation sensor(s) signals 78, compressor operation sensor(s) signals 80, and fuel flow sensor(s) signals 82. Other inputs 84 are provided to controller 70 to generate suitable turbine control outputs 86 as required. The arrows pointing to or from "70" indicate sensor inputs to controller 70, or control signals from controller 70, e.g., to the fuel and water control valves, system parameter monitors and related mechanical, hydraulic, electronic and electromechanical systems of the turbine unit, as the case may be.

In connection with control approaches, an example of a feedback loop comprises measurement of the $NO_x$ in the exhaust gases (the HC zone or output gases adjacent the outlet of the combustor section) by a suitable $NO_x$ sensor, and the amount, rate, temperature, form, phase, mode, purity, etc., of water injected in the process gases or fuel is controlled by the controller to limit the $NO_x$ to a preselected target level range. In a preferred version of this embodiment, the $NO_x$ is continuously monitored for continuous feedback control of the water injection.

In a dynamic-type, operating line or operating chart control system, the adiabatic combustion temperature at the combustor outlet is determined, e.g., by calculation (as shown in our copending Yee et al application identified above), and the water is injected according to a schedule that relates water injection amount/rate/weight % (concentration in the air or air/fuel mixture)/etc., according to a schedule or graphical line that relates water injection to calculated adiabatic combustion temperature. This eliminates the need to measure $NO_x$ in cases where that measurement is costly or too slow for rapid response to changing operating conditions. The final combustion temperature (the adiabatic temperature), based on fuel and air is calculated, and then through a plot like FIG. 2, above, the estimated $NO_x$ that would be produced in the absence of water injection is determined. From this the water amount needed to meet the target $NO_x$ level range can be determined from data of the type shown on FIG. 4, such as in chart, relational database or graphical curve form. The controller follows the resultant line of water weight % vs $NO_x$ to determine the amount to be introduced at the various locations along the gases flow path. The estimated $NO_x$ can include both $NO_x$ from the reaction downstream of the catalyst (primarily thermal $NO_x$) and the $NO_x$ from the preburner (primarily prompt $NO_x$). This also provided the control strategy for addition of water into or upstream of the preburner to control $NO_x$ from that source. Note that $NO_x$ can also be measured at the turbine outlet.

Industrial Applicability

It is clear that the process and apparatus of the invention will have wide industrial applicability, not only to catalytic combustion systems for gas turbines, but also to combustors employed in a variety of other types of power and hot gas producing systems, such as industrial boilers for steam and process heat.

The reduction in $NO_x$ under the inventive process and apparatus is environmentally beneficial, offering the potential for significant amelioration in $NO_x$ produced by high temperature combustion processes, thus lending the invention a wide industrial applicability. Further the increase in power output and turbine efficiency are significant advantages for industrial and energy generation applications of the inventive process, apparatus and control systems.

It should be understood that various modifications within the scope of this invention can be made by one of ordinary skill in the art without departing from the spirit thereof. It is therefore wished that this invention be defined by the scope of the appended claims as broadly as the prior art will permit, and in view of the specification if need be.

What is claimed is:

1. In a method of operating a catalytic combustion system wherein fuel is introduced into and are mixed with process air flowing through a combustor or/and compressor, upstream of a catalyst module in said combustor to form a fuel/air mixture, a portion of the fuel in said fuel/air mixture is combusted in said catalyst module, and a portion of the fuel is combusted in a post catalyst reaction zone downstream of said catalyst module to provide a hot gases stream of a preselected output temperature value, the improvement comprising the step of introducing water from an external source into at least one of said process air, said fuel and said fuel/air mixture in an amount sufficient to reduce $NO_x$ produced in said post catalyst reaction zone.

2. Method as in claim 1 wherein said water is introduced in a phase selected from liquid water, steam, and mixtures thereof.

3. Method as in claim 2 wherein the fuel concentration in said fuel/air mixture is adjusted to compensate for the added mass of water and to maintain the gases output temperature at substantially a preselected value.

4. Method as in claim 3 wherein the water added provides a concentration of water in the range of from about 0.1% to about 20% by weight of the total mass of air and fuel.

5. Method as in claim 4 wherein the amount of water added is in the range of from about 1% to about 5% by weight of the total mass of air and fuel.

6. Method as in claim 2 wherein said introduced water is added simultaneously or sequentially in a plurality of locations along the path of the gases flow through said combustion system.

7. Method as in claim 6 wherein said water introduction locations include at least one of:

adjacent the gases inlet to the catalyst module; in the catalyst module; at the exit of the catalyst module; upstream of a homogeneous combustion zone in said post catalyst reaction zone; in said post catalyst reaction zone; adjacent the introduction of catalyst fuel; intermixed in said fuel; and in association with additional fuel introduced downstream of said catalyst module and upstream of a homogeneous combustion zone, and combination of said locations.

8. Method as in claim 2 in which said catalytic combustion system is disposed in a combustion section of a gas turbine, said combustor section includes a pre-burner section upstream of said catalytic combustion system, a compressor section is disposed upstream of said combustor section, and the output hot gas stream feeds said turbine, wherein said water is introduced selectively in at least one location along the path of gases flow into and through said compressor section and said combustor section, and when water is introduced in a plurality of locations said introduction may be simultaneous or sequential in accord with operating conditions, including selected level of $NO_x$ reduction.

9. Method as in claim 8 wherein water is introduced in at least one mode selected from mixed in said fuel, separately from said fuel or combinations of said modes of introduction.

10. Method as in claim 8 wherein water is introduced in said preburner section in amounts sufficient to reduce $NO_x$ produced in said preburner.

11. Method as in claim 8 wherein water is introduced upstream in said preburner section in amounts sufficient to reduce $NO_x$ produced in said preburner section.

12. Method as in claim 11 wherein water is introduced upstream in at least one location selected from said compressor inlet, interstage in said compressor, and combinations thereof.

13. Method as in claim 1 which includes the steps of measuring $NO_x$ level in at least one of the combustor section gases, combustor section outlet gases, and where the combustor section feeds a turbine, the turbine outlet gases; and controlling the introduction of water to limit the $NO_x$ to a preselected value range.

14. Method as in claim 13 wherein said control step includes a feedback loop comprising substantially continuous measurement of the $NO_x$ level and adjustment of water introduction responsive thereto.

15. Method as in claim 1 in which includes the steps of determining the adiabatic combustion temperature adjacent the outlet of said combustor section; and introducing said water in accord with a schedule of water injection rate to adiabatic combustion temperature needed to reduce $NO_x$ to a preselected target level.

16. Method as in claim 15 wherein said schedule is derived from consideration of $NO_x$ produced vs temperature in said combustor section and $NO_x$ reduction vs water injection.

17. Method as in claim 16 wherein said $NO_x$ value produced at said combustor section temperature is an estimated value of $NO_x$ produced in both said post catalyst reaction zone and in said preburner section.

18. Method as in claim 17 wherein $NO_x$ produced in said preburner is controlled by introduction of water in at least one location of: upstream of said preburner section; in said preburner section; and combinations of said locations.

19. Method as in claim 18 which includes the steps of recovering waste heat from said combustion to convert water to high pressure steam for introduction in at least one of said compressor, said preburner section, and said combustor section.

20. Apparatus for reduction of $NO_x$ produced in a combustor section of a gas turbine downstream of a compressor section, which combustor section includes a catalytic combustion system, comprising:

a) at least one water source;

b) at least one manifold connecting said water source to at least one of said combustion section and said compressor section for introduction of water into the process gasses flowing into and through said compressor section and into and through said combustor section, at selected one or more locations along the flow path of said gases; and c) at least one controller that controls the introduction of water in amounts sufficient to reduce $NO_x$ otherwise produced in said combustor section in accord with a target $NO_x$ value range.

* * * * *